US007578597B2

(12) United States Patent
Hoover et al.

(10) Patent No.: US 7,578,597 B2
(45) Date of Patent: Aug. 25, 2009

(54) OUTDOOR LIGHTING FIXTURE

(75) Inventors: Brandon C. Hoover, Greer, SC (US); James E. Decker, Greenville, SC (US)

(73) Assignee: Hubbell Incorporated, Orange, CT (US)

( * ) Notice: Subject to any disclaimer, the term of this patent is extended or adjusted under 35 U.S.C. 154(b) by 327 days.

(21) Appl. No.: 10/298,265

(22) Filed: Nov. 15, 2002

(65) Prior Publication Data

US 2004/0095772 A1 May 20, 2004

(51) Int. Cl.
*E01F 9/00* (2006.01)
*F21S 13/10* (2006.01)

(52) U.S. Cl. ..... 362/153.1; 362/362; 362/359; 362/431; 40/565; 404/12; 404/13; 404/14

(58) Field of Classification Search ..... 362/153.1, 362/147, 151, 362, 368, 359, 408, 453, 454, 362/441, 431; 404/12, 13, 14; 40/565
See application file for complete search history.

(56) References Cited

U.S. PATENT DOCUMENTS 5,003,441 A 3/1991 Crowe et al.
5,144,540 A 9/1992 Hayes
D330,603 S 10/1992 Kay
5,160,202 A * 11/1992 Legare ..... 362/153.1
5,201,579 A * 4/1993 Roof et al. ..... 362/368
5,230,559 A 7/1993 Porter et al.
5,249,109 A * 9/1993 Denison et al. ..... 362/285
5,278,738 A * 1/1994 Illes ..... 362/147
5,297,013 A * 3/1994 Hall et al. ..... 362/363
5,321,592 A 6/1994 Marinacci
5,414,607 A 5/1995 Harris et al.
5,584,574 A * 12/1996 Haddad ..... 362/359
D377,541 S 1/1997 Porter
5,779,349 A * 7/1998 Reinert, Sr. ..... 362/153.1
5,785,410 A * 7/1998 Branson, Sr. ..... 362/153.1
5,803,594 A 9/1998 Fredrickson et al.
5,984,570 A * 11/1999 Parashar ..... 404/14
6,042,251 A * 3/2000 McCarthy et al. ..... 362/308
6,116,751 A * 9/2000 Remp ..... 362/153
6,206,546 B1 3/2001 Krogman (Continued)

OTHER PUBLICATIONS

Product Information Sheet—USHIO America, Inc., MR-8 Reflector Lamp. 2 pages.

(Continued)

*Primary Examiner*—Jacob Y Choi
(74) *Attorney, Agent, or Firm*—Lance G. Johnson; Mark S. Bicks; Alfred N. Goodman

(57) ABSTRACT

An outdoor lighting fixture that is capable of being mounted flush with a mounting surface is provided. In one embodiment, the outdoor lighting fixture contains a housing having an upper and lower portion. A light source is in operable communication with the housing and can provide light in a direction that is substantially parallel to the mounting surface. It has been discovered that the outdoor lighting fixture of the present invention can be mounted substantially flush with a mounting surface so that it remains relatively hidden from view during use. Furthermore, the outdoor lighting fixture can also provide light in a linear direction, thereby enabling it to illuminate paths, sidewalks, driveways and the like, without having to provide light in all directions.

22 Claims, 4 Drawing Sheets

U.S. PATENT DOCUMENTS

| | | | | |
|---|---|---|---|---|
| 6,210,017 | B1 * | 4/2001 | Miura et al. | 362/153.1 |
| 6,530,675 | B1 * | 3/2003 | Van Etten | 362/267 |
| 6,575,613 | B2 * | 6/2003 | Brown et al. | 362/565 |
| 2001/0050852 | A1 | 12/2001 | Jones | |
| 2002/0008975 | A1 | 1/2002 | Uedono et al. | |
| 2002/0012246 | A1 | 1/2002 | Rincover et al. | |
| 2002/0085374 | A1 * | 7/2002 | Anderson | 362/147 |
| 2003/0012025 | A1 * | 1/2003 | Christen | 362/362 |

OTHER PUBLICATIONS

Product Information Sheet—Lombardo, 1 page.
Product Information Sheet—Kichler. Accent Lighting, 1 page.
Product Information Sheet—Kichler, Accent and Deck lighting, 1 page.
Product Information Sheet—Kichler, Accent/Wall Wash, 1 page.
Product Information Sheet—Hadco, Beacons, 1 page.
Product Information Sheet—Kim Lighting, Lightvault, Bronze Lightvault, Minivault, 1 page.
Product Information Sheet—Kim Lighting, Incandescent Compact Fluorescent, 1 page.
Product Information Sheets—Specialty Lighting, 2 pages.
Product Information Sheet—Visa Lighting, 1 page.
Product Information Sheet—HADCO, The Egg, 1 page.

* cited by examiner

OUTDOOR LIGHTING FIXTURE

BACKGROUND OF THE INVENTION

Landscapers often install a series of outdoor lights along a pathway or other surface for safety and aesthetics. The lights identify and illuminate the pathway while creating a distinctive lighting pattern. Similar lighting is often used to decorative flowerbeds and patio borders, to highlight ponds and garden features, and to otherwise light and decorate residential and commercial grounds as part of the overall landscaping. However, one problem with many conventional outdoor light fixtures is that they are aesthetically unpleasing due their large, bulky shapes. In addition, conventional outdoor light fixtures are often designed in such a manner that light is distributed in virtually every direction, which is often undesired in circumstances that require only minimal lighting.

As such, a need currently exists for an improved outdoor lighting fixture that is relatively hidden from view and that can produce more focused rays of light.

SUMMARY OF THE INVENTION

In accordance with one embodiment of the present invention, an outdoor lighting fixture is disclosed that comprises a housing containing one or more opaque surfaces that define a light cavity. The housing is configured to be positioned proximate to a mounting surface such that at least a portion of the housing is substantially parallel to the mounting surface. The distance from the mounting surface to the maximum height of the housing when mounted is less than about 3 inches, in some embodiments, less than about 2.75 inches, and in some embodiments, from about 1 to about 2.75 inches.

For example, the housing can have an upper portion and a lower portion having opaque surfaces. If desired, the lower portion may be capable of being positioned proximate to the mounting surface and remaining relatively parallel thereto. Further, the upper portion can define an outer flange that extends beyond the perimeter of the lower portion, wherein the outer flange is also capable of being positioned proximate to the mounting surface and remaining relatively parallel thereto. Generally speaking, the portions of the housing may have any desired shape and/or size. For example, in some embodiments, the upper portion of the housing has a parabolic shape.

A light source is positioned within the light cavity of the housing that is configured to provide light in a direction that is substantially parallel to the mounting surface. For example, in some embodiments, the light source is selected from the group consisting of a halogen lamp, fluorescent lamp, incandescent lamp, and combinations thereof. If desired, the outdoor lighting fixture can further comprise an optical lens that is in communication with the light source to distribute in a pattern light rays produced by said light source. In one embodiment, the housing comprises one or more recessed portions that receive the optical lens.

In accordance with another embodiment of the present invention, an outdoor lighting fixture is disclosed that comprises a housing that contains an upper portion and a lower portion having opaque surfaces that define a light cavity. The housing is configured to be positioned proximate to a mounting surface such that the lower portion is substantially parallel to the mounting surface. The upper portion defines an outer flange that extends beyond the perimeter of the lower portion, wherein the outer flange is also capable of being positioned proximate to the mounting surface and remaining relatively parallel thereto. The outdoor lighting fixture further includes a light source that is positioned within the light cavity and an optical lens in communication with the light source to distribute in a pattern light rays produced by the light source.

In accordance with still another embodiment of the present invention, an outdoor lighting fixture is disclosed that comprises a housing that contains an upper portion and a lower portion having opaque surfaces that define a light cavity. The housing is configured to be positioned proximate to a mounting surface such that the lower portion is substantially parallel to the mounting surface. Further, the upper portion has a parabolic shape. The lighting fixture also comprises a light source that is positioned within the light cavity, the light source being configured to provide light in a direction that is substantially parallel to the mounting surface.

Other features and aspects of the present invention are discussed in more detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

Figure 1:
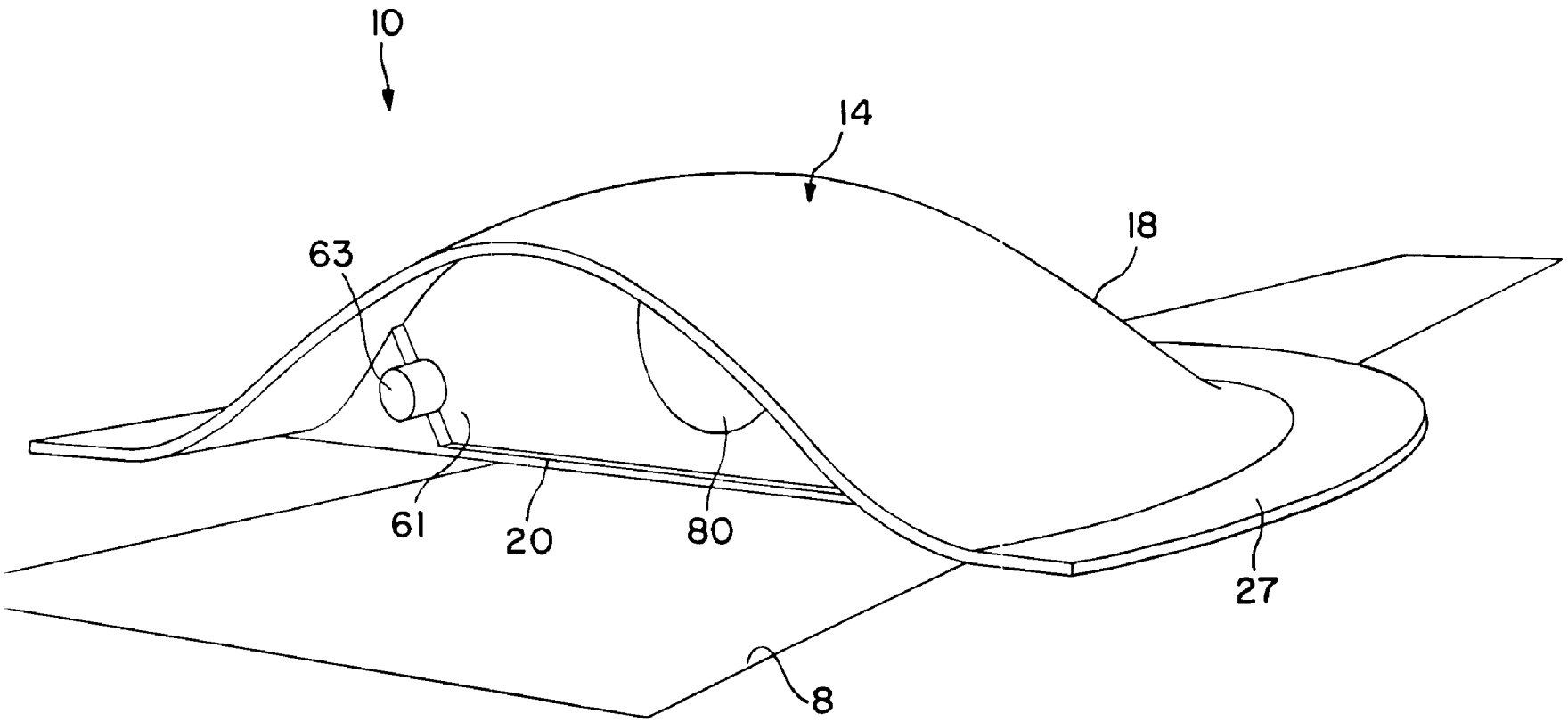
FIG. 1 is an illustration of one embodiment of an outdoor lighting fixture of the present invention mounted flush with a mounting surface.
Figure 2:
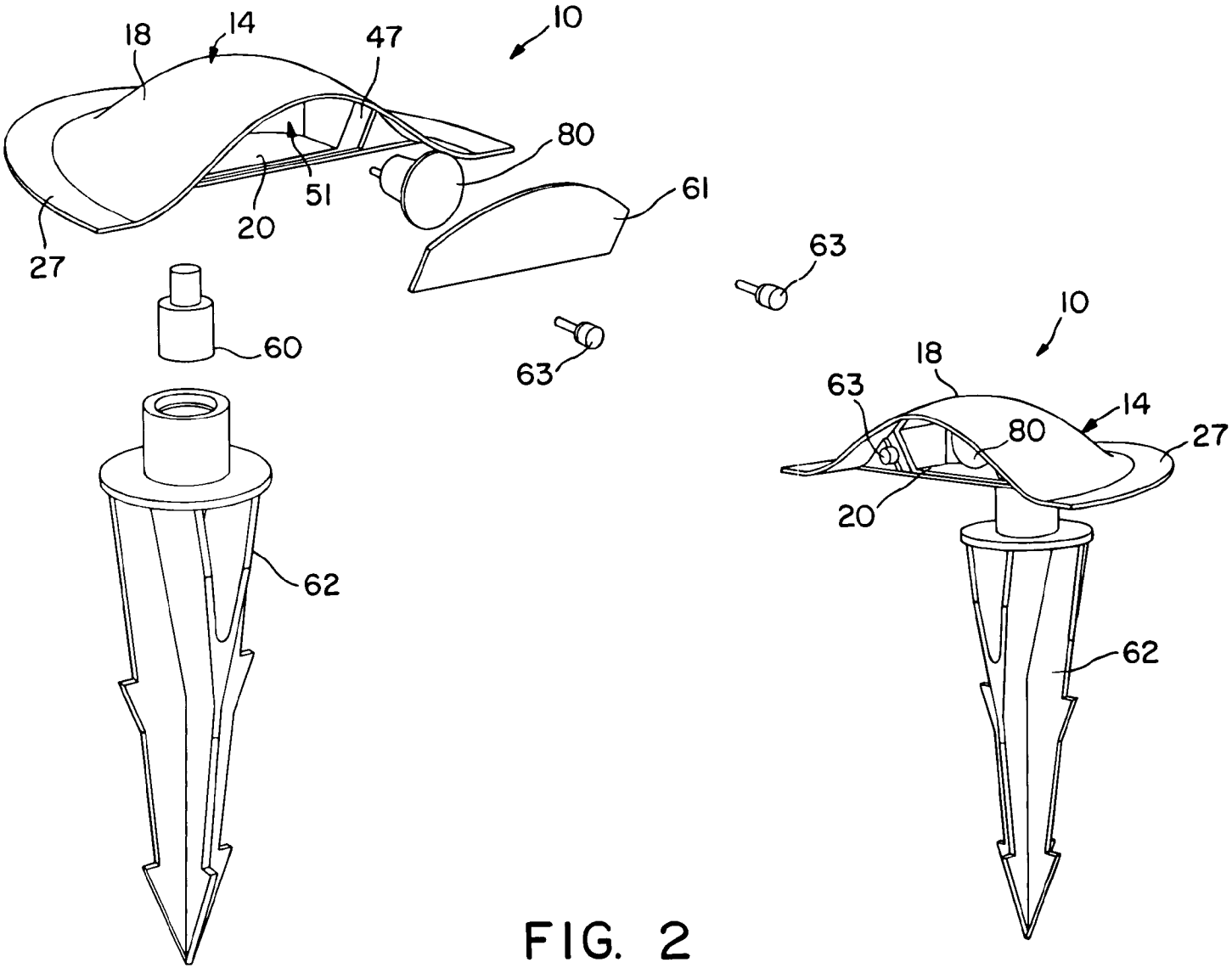
FIG. 2 illustrates one embodiment for assembling an outdoor lighting fixture of the present invention.

Repeat use of references characters in the present specification and drawings is intended to represent same or analogous features or elements of the invention.

DETAILED DESCRIPTION OF REPRESENTATIVE EMBODIMENTS

It is to be understood by one of ordinary skill in the art that the present discussion is a description of exemplary embodiments only, and is not intended as limiting the broader aspects of the present invention, which broader aspects are embodied in the exemplary construction.

In general, the present invention is directed to an outdoor lighting fixture that is capable of being mounted substantially flush with a mounting surface, such as the ground, paved surface, water, etc. In one embodiment, the outdoor lighting fixture contains a housing having an upper portion and a lower portion. A light source is in operable communication with the housing and can provide light in a direction that is substantially parallel (e.g., horizontal, fan-like distribution) to the mounting surface. It has been discovered that the outdoor lighting fixture of the present invention can be mounted substantially flush with a mounting surface so that it remains relatively hidden from view during use. Furthermore, the outdoor lighting fixture can also provide light in a linear direction, thereby enabling it to illuminate paths, sidewalks, driveways, and the like, without having to provide light in all directions.

Referring to FIGS. 1-6, for example, one embodiment of an outdoor lighting fixture of the present invention is illustrated. In particular, an outdoor lighting fixture 10 is shown mounted flush with a mounting surface 8. In general, the type of surfaces in which the outdoor lighting fixture of the present invention may be mounted vary greatly depending on the desired application. For example, it is typically desired that the mounting surface 8 constitute the ground so that the outdoor lighting fixture 10 can illuminate pathways, sidewalks, driveways, decks, steps, flowerbeds, patio borders, garden features, ponds, and the like. However, in other embodiments, the mounting surface 8 can be water so that the outdoor lighting fixture 10 can float on the water and thus be positioned substantially flush therewith.

Regardless of the type of mounting surface, the outdoor lighting fixture 10 contains a housing 14 and, optionally, a coupling member 60 and a mounting stake 62. The coupling member 60 can be connected to the bottom of the housing 14, and then attached to a mounting stake 62 to secure the housing 14 to the ground. However, it should be understood that the coupling member 60 and mounting stake 62 are not required in many applications, such as when the housing 14 is laid directly on the mounting surface 8 or when the housing 14 is placed on water.

The housing 14 can generally have a variety of different configurations. For instance, as shown in FIGS. 1-6, the housing 14 can include an upper portion 18 and a lower portion 20 which have surfaces that are opaque to light to inhibit the amount of illumination provided in direction perpendicular to the mounting surface 8. As shown in FIG. 4, for instance, the upper portion 18 has an interior surface 42 and an exterior surface 44 and the lower portion 20 has an interior surface 46 and an exterior surface 48.

The overall size of the housing 14 can vary depending on the type of outdoor lighting fixture 10 desired. In most applications, the maximum distance "h" (See FIG. 4) from the lower portion 20 to the upper portion 18 will be less than about 3 inches, in some embodiments less than about 2.75 inches, and in some embodiments, from about 1 inch to about 2.75 inches. In one particular embodiment, for instance, the distance "h" is 1.25 inches. In another embodiment, the distance "h" is 2.625 inches. Similarly, the maximum distance from the upper portion 18 to the mounting surface 8 is also generally less than about 3 inches, in some embodiments less than about 2.75 inches, and in some embodiments, from about 1 inch to about 2.75 inches. It should be understood, however, that the maximum distance "h" may vary slightly from the maximum distance from the upper portion 18 to the mounting surface 8, such as when the housing 14 is not mounted directly on the mounting surface 8 but in close proximity thereto.

Further, the length and width of the housing 14 can also be varied. For example, in some embodiments, the length "l" of the housing 14 (See FIG. 5) can range from about 2 inches to about 10 inches, and in some embodiments, from about 5 inches to about 8 inches. In one particular embodiment, for example, the length "l" is 6 inches. Moreover, in some embodiments, the housing 14 can also have a width "w" (See FIG. 5) of from about 2 inches to about 10 inches, and in some embodiments, from about 6 inches to about 9 inches. In one particular embodiment, for example, the width "w" of the housing 14 is 6.825 inches. Although not required, a housing having relatively small dimensions, such as a small distance "h", can provide an outdoor lighting fixture 10 that will be less visible to a user when illuminated, and thus more aesthetically-appealing.

Figure 5:
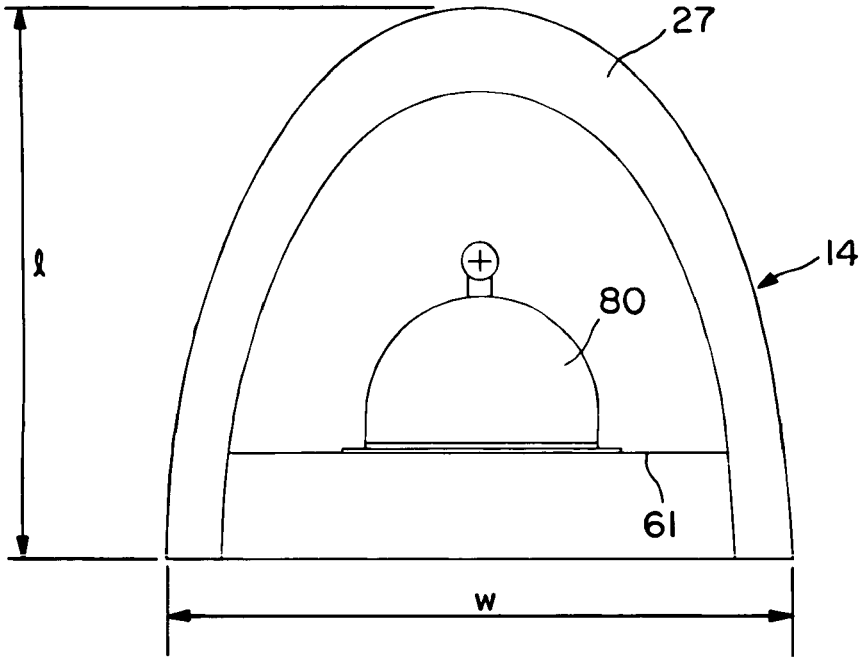
FIG. 5 is a top cross-sectional view of one embodiment of the outdoor lighting fixture of the present invention.
Figure 5:
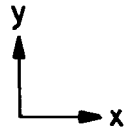
Figure 6:
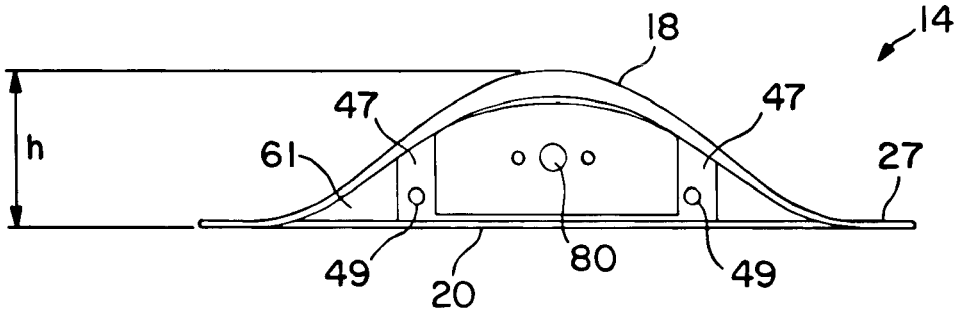
FIG. 6 is a front cross-sectional view of one embodiment of the outdoor lighting fixture of the present invention.
Figure 6:
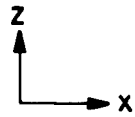

Moreover, the housing 14 can also have a variety of different shapes. For instance, in the illustrated embodiment, the lower portion 20 is substantially flat in the−z direction and has a partially elliptical shape in the x-y plane (FIG. 5). Likewise, the upper portion 18 has a parabolic shape in the x-z plane (FIG. 6) and a partially elliptical shape in the x-y plane. Such a parabolic configuration is achieved, in this embodiment, through the use of an outer flange 27 defined by the upper portion 18. As shown, the outer flange 27 is substantially flat in the−z direction and thus can remain relatively parallel and substantially flush to the mounting surface 8 when positioned proximate thereto. Furthermore, by remaining substantially flat, heat generated by the light source 80 can be more readily dissipated from the interior of the housing 12.

Besides having a parabolic shape, other curved shapes may also be used, e.g., oval, elliptical, circular, irregular curves, etc. Although not required, a "curved" housing shape can further facilitate the dissipation of heat generated by the light source 80, and can also provide a more aesthetically appealing design to a user. However, it should be understood that a curved housing shape is not required in the present invention, and that virtually any shape can be used to form the housing 14. For instance, other examples of suitable shapes for the housing 14 include, but are not limited to, square, rectangular, triangular, circular, oval, trapezoidal, irregular shapes, and the like.

The housing 14 may generally be formed from a variety of different materials. For instance, in some embodiments, a metallic material, such as aluminum, bronze, brass, etc. may be used to form the housing 14. It should be understood that other materials, such as plastics, may also be used in the present invention. Regardless of the particular material used to form the housing 14, it is sometimes desired that a reflective substance, such as white paint, be coated onto one or more surfaces of the housing 14 to reflect the light rays generated by a light source 80. For instance, the interior surfaces 42 and/or 46 may be coated with a reflective substance to enhance the ability of the housing 14 to provide illumination in the desired directions. If desired, the coating may also be placed on other surfaces of the housing 14.

The light source 80 can generally be any type of light or lamp well known in the art, including, but not limited to, halogen lamps, fluorescent lamps, incandescent lamps, and the like. For example, in one embodiment, the light source 80 includes a low-voltage (e.g., 12 volts) halogen lamp having a power of less than about 50 watts, in some embodiments less than about 35 watts, and in some embodiments, from about 25 watts to about 35 watts. In one particular embodiment, an MR 8 Low Voltage Housing Lamp, which is available from Ushio America, Inc. of Cypress, Calif., can be used in the present invention as the light source 80. The MR 8 lamp has a 1-inch diameter and includes a parabolic housing to enhance light dissipation.

Figure 3:
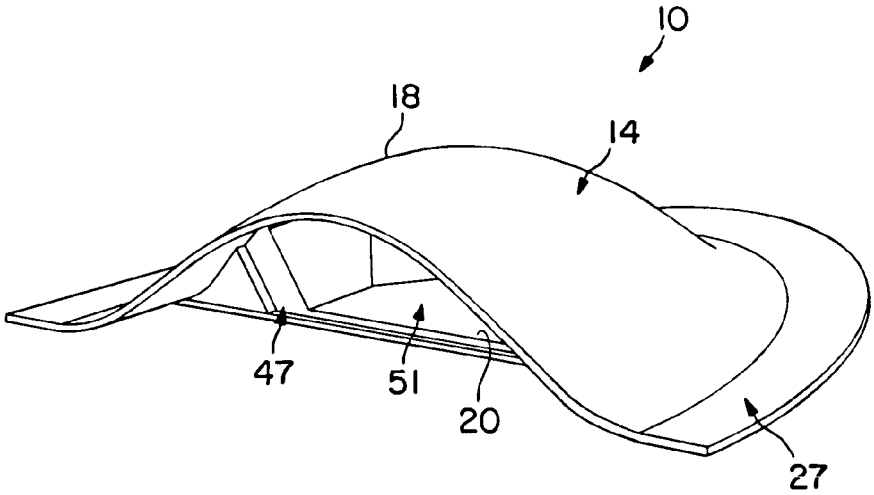
FIG. 3 is a perspective view of one embodiment of an outdoor lighting fixture that can be used in the present invention.
Figure 4:
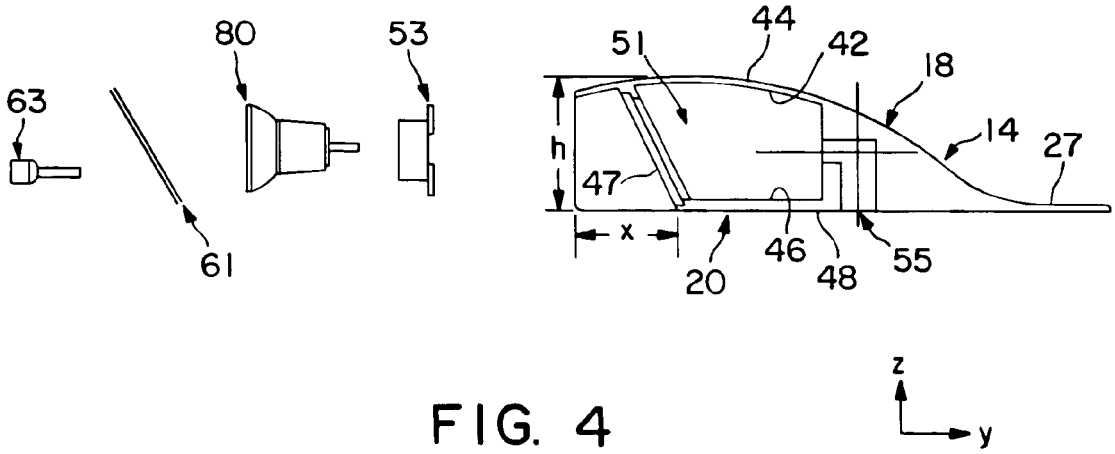
FIG. 4 is a side cross-sectional view of one embodiment of the outdoor lighting fixture of the present invention.

As shown in FIGS. 3-4, the light source 80 may be installed within a light source cavity 51 defined by the interior surfaces of portions 18 and 20. For example, in one embodiment, a bi-pin socket 53 is connected to an opening 55 using a treaded connector (not shown), such as a ⅛ inch NPS (National Pipe Straight) or NPT (National Pipe Taper) threaded connector. In this embodiment, the light source 80 may then be positioned within the socket 53.

If desired, an optical lens 61 that directs light in a certain pattern may be used. The lens 61 can be formed of a transparent material, such as glass, and can allow a portion of the light beam from the light source 80 to pass therethrough, as is conventional in such light fixtures. The optical lens 61 may be selected to have any particular shape so that a multiplicity of direct (down-lighting), indirect (up-lighting) or outward lighting patterns may be produced, such as through prisms or ridges that produce a preselected light pattern. In one embodiment, the lens 61 is a generally flat lens. Alternatively, a lens 61 having a convex portion can also be utilized. Regardless, the optical lens 61 cooperates with the housing 14 and the light source 80 to produce a light pattern that is substantially parallel to the mounting surface 8.

To connect the optical lens 61 to the housing 14, a variety of techniques may be utilized. For example, in one embodiment, such as shown in FIGS. 2-4 and 6, the housing 14 is equipped with one or more recessed portions 47 capable of accepting the optical lens 61. In the illustrated embodiment, for instance, one or more surfaces of the lens 61 can be recessed a distance "x" (FIG. 4) from the front face of the housing 14. In some embodiments, the distance "x" can be less than about 5 inches, in some embodiments from about 1 to about 5 inches, and in some embodiments, from about 1 to about 2 inches. The optical lens 61 can be mounted by inserting one or more fastening devices 63 (e.g., screws) through holes 49 that align with similar holes in the recessed portions 47. As a result, the lens 61 can cover the light source cavity 51 to seal it to the housing 14. In another embodiment, a retaining outer ring may be used with fastening devices to claim the lens 61 into place in the recessed portions 47. Gaskets or sealants may also be used to waterproof the light source cavity 51.

As a result of the present invention, it has been discovered that the outdoor lighting fixture can be mounted substantially flush with a mounting surface so that it remains relatively hidden from view during use. The ability of the fixture to remain hidden can be enhanced by minimizing the distance from the mounting surface to the maximum height of the housing. For example, in some embodiments, the distance from the mounting surface to the maximum height of the housing is less than about 3 inches, in some embodiments, less than about 2.75 inches, and in some embodiments, from about 1 to about 2.75 inches. Furthermore, the outdoor lighting fixture can also provide light in substantially a linear direction, thereby enabling it to illuminate paths, sidewalks, driveways, and the like, without having to provide light in all directions. Such linear illumination can be enhanced by utilizing a housing having opaque surfaces and by enhancing the reflectivity of the inner cavity using, for instance, reflective paint, optical lenses, and the like. Further, the shape of the housing (e.g., parabolic) can also enhance the ability of the lighting fixture to provide light in a linear direction, while remaining relatively hidden from view.

These and other modifications and variations of the present invention may be practiced by those of ordinary skill in the art, without departing from the spirit and scope of the present invention. In addition, it should be understood that aspects of the various embodiments may be interchanged either in whole or in part. Furthermore, those of ordinary skill in the art will appreciate that the foregoing description is by way of example only, and is not intended to limit the invention so further described in such appended claims.

What is claimed is:

1. An outdoor lighting fixture having a low profile, comprising:

a substantially flat lower housing and a curved, opaque and one-piece upper housing that is directly joined to said lower housing on rear and lateral sides to define a light cavity and a single forward-facing opening, said lower housing being capable of being positioned proximate to a mounting surface such that at least a portion of said lower housing is substantially parallel to said mounting surface, said upper housing having a substantially parabolic cross section in a vertical plane and a substantially elliptical cross section in a horizontal plane;

a lens disposed in said opening and substantially sealing said light cavity from water;

a light source that is positioned within said light cavity, said light source being configured to provide light out thru said opening in a direction substantially parallel to said lower housing.

2. An outdoor lighting fixture as defined in claim 1, wherein a distance from said lower housing to maximum height of said upper housing is less than about 2.75 inches.

3. An outdoor lighting fixture as defined in claim 1, wherein a distance from said lower housing to the maximum height of the upper housing is from about 1 to about 2.75 inches.

4. An outdoor lighting fixture as defined in claim 1, wherein said upper housing defines an outer flange that extends beyond said lens.

5. An outdoor lighting fixture as defined in claim 1, wherein said lower and upper housings are formed from a metallic material.

6. An outdoor lighting fixture as defined in claim 1, wherein said lower and upper housings have an exterior surface and an interior surface, wherein at least a portion of said interior surface is coated with a reflective substance.

7. An outdoor lighting fixture as defined in claim 1, wherein said lens directs light from said light source in a pattern.

8. An outdoor lighting fixture as defined in claim 1, wherein said light source is selected from the group consisting of a halogen lamp, fluorescent lamp, incandescent lamp, and combinations thereof.

9. An outdoor lighting fixture, comprising:

a curved, one-piece and opaque upper housing spaced apart from an opaque, flat lower housing that define therebetween a light cavity directing light in a planar direction between said lower and upper housings and a single forward-facing opening, said lower housing being configured to be positioned proximate to a mounting surface such that said lower housing is substantially parallel to said mounting surface, wherein the distance from said lower portion to the maximum height of said upper portion of said housing is less than about 3 inches and said upper housing has a substantially parabolic cross section in a vertical plane and a substantially elliptical cross section in a horizontal plane, said upper housing being sealed against said lower housing on rear and lateral sides of said light cavity;

a light source that is positioned within said light cavity, said light source being directed to provide light in a linear direction from said light cavity through said opening; and a lens disposed in said opening and covering and sealing said light cavity.

10. An outdoor lighting fixture as defined in claim 9, wherein a distance from said lower housing to the maximum height of said upper housing is less than about 2.75 inches.

11. An outdoor lighting fixture as defined in claim 9, wherein a distance from said lower housing to the maximum height of said upper housing is from about 1 to about 2.75 inches.

12. An outdoor lighting fixture as defined in claim 9, wherein said upper housing defines an outer flange that extends beyond the perimeter of said lens.

13. An outdoor lighting fixture as defined in claim 9, wherein said lens comprises prisms that direct light from said light source in a pattern.

14. An outdoor lighting fixture having a low profile, comprising:

a curved, opaque and one-piece upper housing spaced apart from an opaque lower housing to define a light cavity therebetween and a single forward-facing opening through which light is directed outwardly from said cavity in a linear direction parallel to said lower housing, and said upper housing having a substantially parabolic shape sealed against said lower housing on rear and lateral sides of said light cavity;

a lens disposed in said opening to seal said light cavity from water; and a light source that is positioned within said light cavity and directing light out of said cavity through said opening in said linear direction, wherein said lens is an optical lens having prisms that direct light rays produced by said light source in a pattern, and wherein said upper housing has an outer flange extending beyond said lens.

15. An outdoor lighting fixture as defined in claim 14, wherein a distance from said lower housing to the maximum height of said upper housing is less than about 3 inches.

16. An outdoor lighting fixture as defined in claim 14, wherein a distance from said lower housing to the maximum height of said upper housing is less than about 2.75 inches.

17. An outdoor lighting fixture as defined in claim 14, wherein a distance from said lower housing to the maximum height of said upper housing is from about 1 to about 2.75 inches.

18. An outdoor lighting fixture having a low profile, comprising: a curved, opaque and one-piece upper housing connected to a flat and opaque lower housing that define a light cavity and a single, forward-facing opening, said lower housing being configured to be positioned proximate to a mounting surface such that said lower housing is substantially parallel to said mounting surface, said upper housing having a substantially parabolic shape in a vertical plane that is sealed against said lower housing on rear and lateral sides of said light cavity, and said upper housing have a substantially elliptical cross section in a horizontal plane;

a light source that is positioned within said light cavity, said light source being configured to provide light in a direction out of said light cavity through said opening that is substantially parallel to the lower portion; and a lens disposed in said opening and covering said light cavity and sealing said cavity from water.

19. An outdoor lighting fixture as defined in claim 18, wherein said upper housing defines an outer flange that extends beyond said lens to provide a hood over said lens for protection from water and restriction on direction of said light.

20. An outdoor lighting fixture as defined in claim 18, wherein a distance from said lower housing to the maximum height of said upper housing is less than about 3 inches.

21. An outdoor lighting fixture as defined in claim 18, wherein a distance from said lower housing to the maximum height of said upper housing is less than about 2.75 inches.

22. An outdoor lighting fixture as defined in claim 18, wherein a distance from said lower housing to the maximum height of said upper housing is from about 1 to about 2.75 inches.

* * * * *